US005542329A

United States Patent [19]

Chen

[11] Patent Number: 5,542,329

[45] Date of Patent: Aug. 6, 1996

[54] DEVICE FOR IMPROVING SOUND IN GUITARS AND SIMILAR STRINGED INSTRUMENTS

[76] Inventor: Shin H. Chen, 6140 N. Lincoln, Rm. 116, Chicago, Ill. 60659

[21] Appl. No.: 910,104

[22] PCT Filed: Sep. 6, 1990

[86] PCT No.: PCT/US90/05056

§ 371 Date: Jul. 6, 1992

§ 102(e) Date: Jul. 6, 1992

[87] PCT Pub. No.: WO92/04711

PCT Pub. Date: Mar. 19, 1992

[51] Int. Cl.[6] ..... G10D 3/00; G10D 1/08

[52] U.S. Cl. ..... 84/291; 84/294; 84/267

[58] Field of Search ..... 84/267, 275, 277, 84/291, 294, 295, 296

[56] References Cited

U.S. PATENT DOCUMENTS 1,275,351 8/1918 Yeakey ..... 84/291

4,026,181 5/1977 Barcus et al. ..... 84/291

*Primary Examiner*—Michael L. Gellner
*Assistant Examiner*—Cassandra Spyrou

[57] ABSTRACT

A wishbone shape articulated lateral drive assembly (19, 20) is mounted on the inner panel of the back plate (13) in a stringed instrument to energize and drive said plate (13) sideways causing sound box (15) panels to generate phase distinct vibrations as a result of sound boards' (12, 13) unison flapping movement so that clarity and response of tones improved.

In order to combine the improved sound with the original sound of the instrument for increasing the tonal range, manual switching capability (21) is provided within the sound box (15) for selection of tone colors from outside the instrument. A treble enhancing assembly (45, 47) additionally is provided to brighten the instruments' sound in general and highlight the treble in particular so that tone color is improved beyond that which can be provided by conventional instruments.

2 Claims, 2 Drawing Sheets

DEVICE FOR IMPROVING SOUND IN GUITARS AND SIMILAR STRINGED INSTRUMENTS

This invention relates to improvement of sound in stringed instruments such as guitars or other instruments which have hollow bodied resonating means and is more particularly concerned with tone color, response, and range effected by said means or the sound box. Generally, the sound box comprises a sidewall structure and a set of at least mildly arched sound boards that vibrate and stir the surrounding air to create and propel sound waves through a hole or "F" holes in top board of the instrument.

These conventional instruments such as guitars have well established designs and the sound box is rather vacuous in construction with bracings inside forcing and forming a mildly arched back plate and a somewhat less arched top board. The later also serves as an anchor base for the string bridge that receives and propagates vibratory movements from the energized (plucked or bowed) strings starting from the bridge base at the center of said board toward the sidewall structure, and continuously to the back plate, in ripple manner and involving time lapes in the process. One design (U.S. Pat. No. 360,317) incorporates multiple push rods connected to the sidewall structure forming a non distance-variable construction. Another design (U.S. Pat. No. 4,343,940) includes a sound transmitting assembly that utilizes one-piece straddle bridge with conductor means to energize the central area of the back plate in a permanently engaged mode.

These designs all fail to provide a distinctly superior tone production means for the instruments to fully satisfy modern day virtuosi's demand because: 1, the ripple manner of vibratory propagation, due to said time lapes, allows the phases to overlap or one phase to disturb the other resulting in muddy sounds. 2, said time lapes also contributes to "dragging" of notes played and hinders musicians from performing more rapid riffs or achieving clear contrapuntal lines. 3, the multiple rod design forming a non distance-variable, therefore rigid, sidewall structure merely constrains the sound boards and affects the production of desirable sounds. 4, the one-piece straddle bridge design has merit in causing the central area of the back plate to vibrate in synchronous phase with the same area of the top but, due to the non-articulated or nonlateral driving nature of the bridge member, it leaves the remaining large area of the sound box panels to lag behind phasewise, preventing a full potential in clarity of sound production from being realized. 5, said permanently engaged assembly, lacking in tone selection control, provides only a limited tonal range to no wider than that of the traditional design and its lack of treble enhancing means further prevents production of brilliant sounds.

The invention as claimed is to remedy these shortcomings. It solves the problems in designing acoustic stringed instruments with improved clarity in tone that can only be achieved by generating synchronously phased vibratory movements over the sound box panels with practically no time lapes in said movements. The improvement allows productions of quick responding, non-dragging and non-overlapping notes (when so desired) from the instruments and it is achieved by providing within the sound box an articulated straddle bridge which mainly functions as a laterally directed drive means that energizes and drives the peripheral areas of the back plate sideways, that is, it stretches the plate toward both sides during the energizing phase of a vibratory cycle. The energized drive simultaneously causes the entire sound box to flatten or the mildly arched both sound boards to flap in unison, bypassing the ripple factor, thereby phase distinct vibratory movement of the sound box realized.

The invention also extends the tonal range to beyond the limit of that of conventional acoustic stringed instruments through enhancing treble tone in general and by incorporating tone selector means that allows musicians to instantly disengage, engage, or manipulate the tensions of the new acoustic driver assembly for selecting dark, medium, or brighter tone colors respectively by a flip of the manual switch means from outside of the instrument.

It is highly desirable for a polyphonic instrument such as a guitar to have capabilities such as disclosed above, to sound clearly and respond quickly notewise when the instrument is played, especially where the music involves complex, dissonance inclined contrapuntal compositions. By combining an extended tone color range and the improved tone quality in the instrument, there is provided an advantageous method and device for perfect adaptation in stringed instrument to meet musicians' demand acoustically. Another benefit of the invention pertains to easy retrofit of the device to improve existing countless guitars and similar instruments acoustically by providing easy installation kits for owners of said instruments. The present invention also provides a method of bilateral driving of instrument sound box by utilizing segments joined in a wishbone shape forming an articulated energy diverting mechanism to motivate both sides of sound board margins.

One way of carrying out the invention is described in detail below with reference to drawings which illustrate only one specific embodiment, in which.

Figures 1, 5A, 5B, 5C:
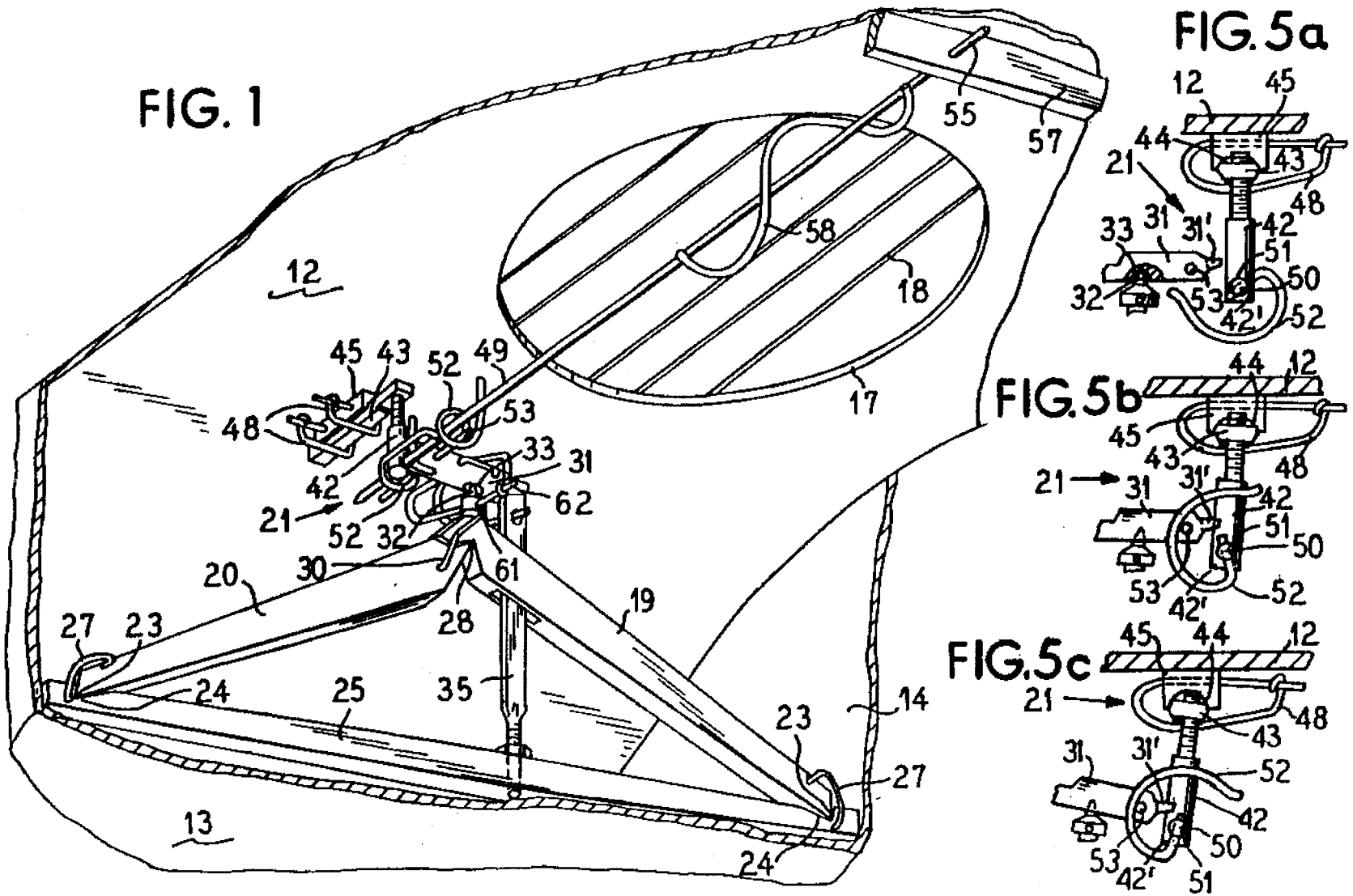
FIG. 1 is a schematic elevational detail view looking upwardly through the body of the guitar of FIG. 2 showing therein the new sound improvement-selection mechanism of the present invention.
Figure 2:
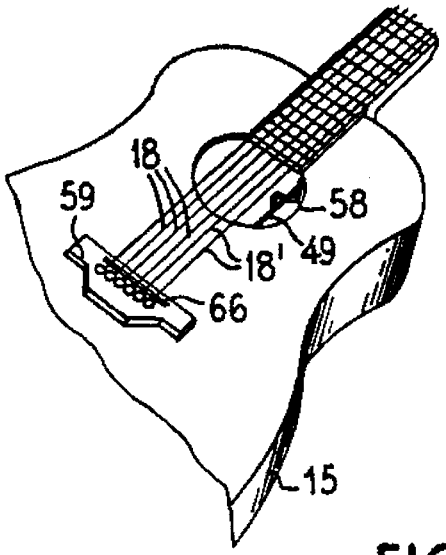
FIG. 2 is a perspective view of the body of the guitar representing a stringed instrument providing reference for FIG. 3.
Figure 3:
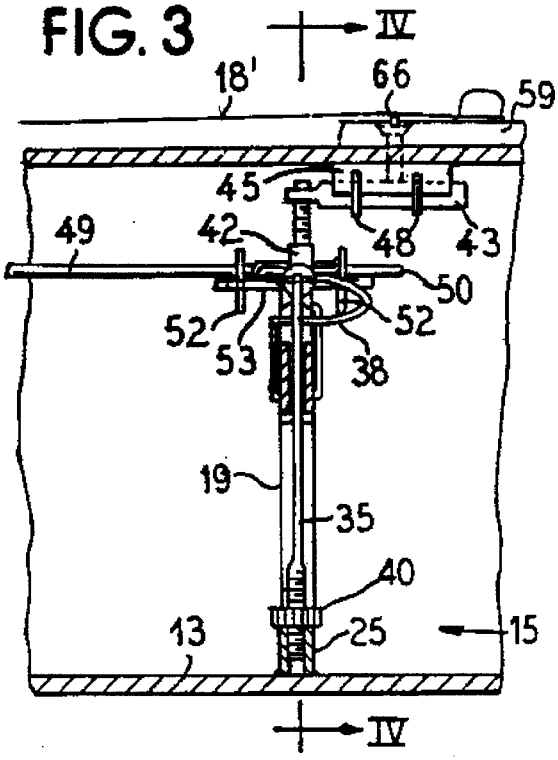
FIG. 3 is a fragmental sectional elevational view of the sound improvement-selection mechanism.
Figure 4:
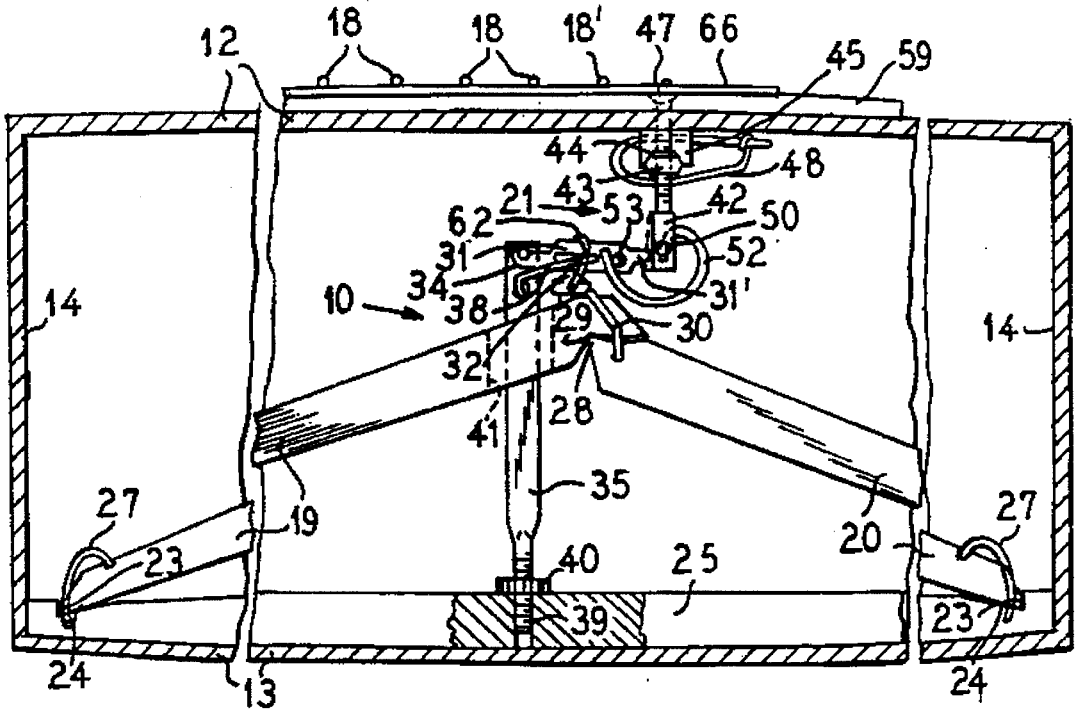
FIG. 4 is a fragmental vertical detail view taken along the sectional line IV—IV in FIG. 3.

FIGS. *5a*, *5b* and *5c* are an enlarged detail view of the tone selection assembly showing disengaged mode in FIG. 5(*a*), engaged mode in FIG. 5(*b*), and tensioned mode in FIG. 5(*c*).

The figures show a guitar, or similarly constructed stringed instruments comprising a body or sound box 15 including top board 12, back plate 13, a sidewall structure 14 joining said boards and defining a chamber 15 into which a sound hole 17 through the sound board 12 opens under playing strings 18 stretched lengthwise.

According to the present invention, the assembled device 10 comprises segments (19, 20) joined in an articulated wishbone shape energy diverting bilateral drive mechanism 19 and 20 within the sound box chamber 15 and said device 10 is switchably by means of cam member 52 with extension rod 49 connected to the treble strings 18' area of anchoring member via a tone selection switch assembly 21, including a treble tone enhancing pin screw 47 which is in immediate connection with said treble strings 18'. The back plate 13 provides anchor bearings for drive mechanism 19 and 20 by means of drive tips 23 and drive notches 24 combination anchored by quick mount spring fasteners 27.

In a preferred construction, the drive arms 19 and 20 are cooperatively disposed in a upwardly convergent relation, with lower end respective rocker tips 23 received in complementary notches 24 in an existing bracing bar 25 or in equivalently patched wood segments where such bracing is absent or dislocated, rockably fastened by spring fasteners 27. The bracing 25 is generally glued onto the inner back panel in parallel with and beneath the off-upper edge of member 59 above. At their upper ends, the arms 19 and 20 are connected in an articulated manner, wherein the arm 19 has a downward facing inverted V notched bearing 29 which receives complementary tip 28 of drive arm 20, together forming an expanded wishbone configuration. Resilient spring clamps 30 and 27 fasten respective rocker couplings for buzz free movement. Said articulated coupling of the upper arm parts 28 and 29 forms a lateral distance expandable driving between bearing notches 24's.

Mounted rigidly on the crown of the arm 19 for effecting said driving is an upwardly projecting needle pointed fulcrum spindle 32 which engages in a complementary fulcrum socket 33 in the lower side face of the lever 31 and fastened by a spring clamp 62 that loops through the eye 61 around the fulcrum coupling, and holds the lever 31 firmly but rockably in place. One end of the lever 31 has a bifurcation 34 in which is received the upper thrust relation by the bifurcation 34 and maintained by biasing means comprising a spring member 38 engaged at one end with the lever 31 and at its opposite end with the post 35. The post 35 is rigidly supported by means of the bar 25 into which a lower threaded terminal 39 of the post is secured and rigidly locked by means of a lock nut 40. From the bar 25, the post 35 extends upwardly through a clearance hole 41 in the arm 19. At its energy receiving end 31' of the lever 31 there is transversely welded coupling rod 53 for the paired spiral cam fingers 52 of the switching mechanism 21. Said rod 53 is positioned so that each segment is within the orbit of the tip of the parallel pair cam fingers 52. These fingers have graduated radii for varying the distance and the tension of the grip of the rod 53 to engage assembly 21 with assembly 10 when said fingers 52 are turned and said radii reduced. Further turning of said fingers 52 causes said energy lever tip 31' to be pulled to slide lower in the direction of journal bearing 51 and exerts varying degree of tensions to said boards 12 and 13 via post member 35, and post stem 42 of switching assembly 21. Said assembly 21 includes a vibratory force exerting cradle bar 45 which is fixedly secured to the underside of the board 12 and generally in line with the treble strings 18' as by means of a metal treble tone enhancing pin screw 47 with its pin head in contact with the treble section of saddle 66. Said pin screw 47 functions to directly channel vibratory energy to the board 12, or both boards 12 and 13 and prevents treble energy from being absolved by the wooden material of member 59.

Center biased spring retainers 48 retain an inverted L sliding beam 43-post stem 42 vibratory force exerting extension for said cradle bar 45 with its half round beam segment 43 coupled firmly within the channel 44 of cradle bar 45 forming the core of said tone selection means 21 by affording said stem 42 to move and engage with lever tip 31' to effect driving of assembly 10. Said post stem 42 is in immediate proximity to the lever contact edge 31' mounted on the free standing driver assembly 10 and, at its stem terminal 42', a transverse bearing 51 is provided to carry a switching Journal 50 which, in turn, carries said cam fingers 52 in an engageable relationship with said coupling rod 53. A light weight switch body extension 49 is provided, allowing an ever-accessible helix grip sections 58 exposed to the sound hole opening, and the extension end 55 is securedly born by upper bracing 57. For "F" holed instruments, a switch rod such as 49 may be alternatively designed to pass through the end pin of an instrument for similar tone selection purpose. Hardwood, light weight metal, or a combination of both may be used for the parts of said device.

I claim:

1. In combination:

A stringed musical instrument having a sound box;

said sound box having a top board, a bottom plate and a sidewall structure; said sidewall structure having a first edge and a second edge;

wherein said first edge attached to said top plate and said second edge attached to said bottom plate defining a chamber;

an energy diverting means removably mounted within said chamber of said soundbox and comprising segments joined in a wishbone shape;

A first of said segments removably connected to said top plate adjacent said first edge and a second of said segments removably connected to said bottom plate adjacent said second edge;

said instrument further comprising a bridge mounted to said top board outside said chamber and having a treble string supporting section;

A tone enhancing pin screw attached to said treble string supporting section of said bridge and extending within said chamber;

A switching means for selectively connecting said energy diverting driving means and said tone enhancing pin screw having an engaged and a disengaged positioned;

whereby in the engaged position the switching means channels sound wave energy from the treble string position to said energy diverting driving means; said energy diverting driving means said bottom plate adjacent said second edge with the channelled sound energy for enhanced sound.

2. The combination of claim 1 wherein:

said top board further comprising a sound hole opening;

said switching means further comprising a cam means adjacent said sound hole opening for manually selecting said engaged or said disengaged position.

* * * * *